United States Patent [19]

Wanthal

[11] Patent Number: 5,075,034

[45] Date of Patent: Dec. 24, 1991

[54] INDUCTION CURABLE TWO-COMPONENT STRUCTURAL ADHESIVE WITH IMPROVED PROCESS ABILITY

[75] Inventor: Mark A. Wanthal, San Francisco, Calif.

[73] Assignee: The Dexter Corporation, Pittsburg, Calif.

[21] Appl. No.: 404,709

[22] Filed: Sep. 8, 1989

[51] Int. Cl.[5] ..... H01B 1/06

[52] U.S. Cl. ..... 252/511; 252/503; 252/506; 523/137; 523/458; 523/459; 523/468

[58] Field of Search ..... 252/511, 512, 513, 519, 252/503, 506; 523/457–459, 468, 137

[56] References Cited

U.S. PATENT DOCUMENTS 4,410,457 10/1983 Fiyimura et al. ..... 255/511

4,762,864 8/1988 Goel et al. ..... 523/458

*Primary Examiner*—Josephine Barr

*Attorney, Agent, or Firm*—Pennie & Edmonds

[57] ABSTRACT

A two component adhesive composition which is curable by induction heating is provided. The presence of an effective amount of conductive carbon black along with an effective amount of an electromagnetic energy absorbing material such as iron oxide in the adhesive composition allows one to reduce the time for induction curing and/or allow the use of low frequency induction generators (less than or equal to 10 KHz) in the bonding of fiber reinforced engineering thermoset, thermoplastic materials and other plastics.

25 Claims, No Drawings

INDUCTION CURABLE TWO-COMPONENT STRUCTURAL ADHESIVE WITH IMPROVED PROCESS ABILITY

BACKGROUND OF THE INVENTION

1.Technical Field

The present invention relates to adhesive compositions for use in bonding fiber reinforced engineering thermoset or thermoplastic materials. More particularly, it relates to adhesive compositions containing electrically conductive materials such as carbon black in combination with ferromagnetic materials to provide a synergistic effect to improve the processing of induction accelerated adhesives especially when low frequency induction coils are used.

2. Background Art

Manufacturers of products that use fiber reinforced engineering thermoset or thermoplastic materials for structures rely on adhesive bonding to join these materials. Typically, in the case of automotive applications a class A paintable surface grade of sheet molding compound (SMC) fiber glass material is bonded to an inner reinforcing member. When manufacturing parts at a rate of one per minute or less, a fast bonding process is required. Traditionally, a two component adhesive was applied, the parts mated, and then held in contact over and under by electrically or steam heated tooling to accelerate the adhesive to a gelled state by thermal conduction. Once gelled, the assembly is dimensionally stable and can be moved off line. The adhesive will then cure to full strength down line at ambient temperatures. Heated fixture tooling must first heat the SMC and then conduct heat into the adhesive to cause the gelation. Two and a half to three minutes was a typical bonding cycle. Advances in SMC molding technology have reduced part molding times below one minute; consequently, short bonding cycles are required to keep pace.

Induction heating has been employed to speed up the bonding process. The adhesive is modified by suspending ferromagnetic particles in the polymer. When placed over a high frequency (450 kHz or higher) current, the induced magnetic field causes the ferromagnetic particles to heat up and dissipate their heat to the adhesive thereby gelling the polymer matrix in about 40 seconds. Induction heating eliminated the need for two side access heated fixtures since the adhesive could be heated directly with one side access induction tooling.

This process of inductively heating adhesives containing only ferromagnetic particles, however, requires a high frequency current (450 kHz or higher) to create a magnetic field that could couple to the small particles in the adhesive. These high frequency generators are based on vacuum tube technology. They are costly and inefficient in operation. High power losses are suffered when the high frequency current is transmitted to the induction coil by a solid copper bar. In order to cope with the transmission line losses, the transmission line must be short in length with high frequency induction generators. This places the generator and the coil in close proximity causing congestion in the immediate work area. High operating voltages (5000 - 8000 volts) are used with high frequency induction generators. Because of the high operating voltages, arcing is a major concern when designing high frequency induction coils and associated work stations. Arcing is a severe safety hazard requiring many safeguards to prevent electrical shock. High transmission line losses also require that the induction coil be fitted with expensive magnetic concentrators in order to maximize the field's effectiveness. The inefficiencies also result in the use of high volumes of cooling water. Because the high frequency induction generators are based on vacuum tube technology, the maintenance of these machines is high. High frequency induction generators may interfere with radio transmission in the local area as well as other electronic equipment in the immediate area. As a result, all 450 kHz generators must be FCC certified.

Accordingly, it is an object of the present invention to provide improved adhesive compositions which allow SMC and other plastics to be bonded in less then one minute with improved processing by virtue of their ability to be heated by low frequency induction generators.

Another object of the present invention is to provide novel adhesive compositions useful in induction heat bonding substantially free of the drawbacks currently known for high frequency induction heating in terms of complexities in design and implementation.

The present invention is also capable of being employed to advantage with high frequency generators. Used in this manner even shorter cycles are possible.

These and other objects and features of the invention as well as the advantages thereof can be fully understood by reference to the following description and claims.

SUMMARY OF THE INVENTION

The foregoing objects are achieved by the present invention by the inventor's discovery of new adhesive compositions comprising of electrically conductive particles in addition to the ferromagnetic particles. The adhesives compositions with carbon black loadings in the range of 0.1 - 25.0 weight percent and preferably in the range of 1-7 weight percent have been found amenable to rapid heat bonding with the use of low frequency (less than or equal to 10 kHz) induction generators.

The adhesive compositions are based on two components such as those described in U.S. Pat. No. 4,762,864 but with the addition of carbon black. One component (epoxy resin component) comprises an epoxy resin mixture. Examples of resins that are commonly used are glycidyl ethers of bisphenols (including bisphenol A, bisphenol F and bisphenol S); glycidyl ethers of other polyhydric phenols; glycidyl ethers of glycols; glycidyl amines, for example bis(epoxy propyl) aniline; glycidyl ethers of phenol and substituted phenols; glycidyl ethers of alcohols and mixtures thereof.

This epoxy resin component may be modified with a phenolic cure accelerator such as Bisphenol A, resorcinol, salicylic acid or phenol (up to 15% by weight).

This epoxy resin component is filled with 2 to 60% by weight and preferably 20-35% by weight of the other epoxy ingredients with an electromagnetic energy absorbing material which includes particulate magnetizable metals including iron, cobalt and nickel or magnetizable alloys of nickel and iron, alloys of nickel and chromium, and inorganic oxides such as ferric oxide and nickel oxide and carbonaceous compositions and mixtures thereof, for the purpose of electromagnetic energy absorbance. Electrically conductive carbon black is added to this epoxy resin component in the range of 0.1 to 25.0 percent by weight and preferably in the range of 1 to 7 percent by weight so as to sufficiently lower the volume resistivity of the entire adhesive mixture to effect rapid low frequency induction heating.

It is important to properly choose the type of carbon black to be used in the adhesive composition. Conductivity achieved by the use of carbon black is dependent on the formation of reticulate chains of carbon black particles through which electrons can flow. As a result, the carbon black should be relatively fine in particle size and high in structure. Small particle sized carbon (i.e. less than 40 nanometers) with high specific surface area (i.e. greater than 200 square meters per gram) are favored for high conductivity. Commercial furnace blacks (such as Columbian Chemical's Conductex SC, Degussa's Printex XE-2 and Cabot's XC-72) have been specially manufactured to meet these requirements. Optimum conductivity is dependent on proper dispersion of the carbon black. Over dispersion can result in diminished conductivity by over shearing and destroying the structured chains through which electrons can travel.

Other commonly used fillers such as talc, kaolin, silica, aluminum oxide etc. (up to 30% by weight of the epoxy resin) and thixotropic character can be built up by the addition of fumed silica (1 to 8% by weight based on the epoxy resin). It has been found that the use of di- or tri- glycidyl ethers of polyalkylene glycol also helps to improve the thixotropic property of the component and reduces the dilatency of the resin. Optionally, additional chemical thixotropic materials such as isocyanates at 1 to 15% by weight as described in U.S. Pat. No. 4,576,124 may also be added.

The epoxy resin component may be modified from 1 to 40% by weight based on the weight of the epoxy, and more preferably from 10 to 20%, with material included for the purpose of imparting toughness and improving flexibility. Commonly used examples of such materials include carboxylic acid terminated butadiene-acrylonitrile rubber; acrylonitrile-butadiene-styrene terpolymers; urethane elastomers; dimer and trimer acids; polyamides and polyoxyalkyleneamines.

The second component which is designated the hardener component comprises 5 to 80 percent aromatic ring containing aliphatic polyamine preferably Cardolite NC-540. Other commonly used amines can be used as the curing agent. Examples of such are dimer and trimer acid based polyamides, polymethylene diamines, piperazine ring containing aliphatic amines, Mannich base curing agents based on cycloaliphatic amines, polyether polyamines and polyamines such as DETA.

The hardener component may also contain an amine cure accelerator specifically benzyldimethylamine. Other commonly used accelerators may also be used. Examples of such are Lewis acid catalyts such as boron trifluoride amine complexes, other secondary and tertiary amines such as trisdimethylaminoethyl-phenol. Alternatively, phenolic cure accelerators discussed previously may be added to the hardener component to speed the cure rate.

The hardener component can also contain modifiers to impart toughness and improve flexibility. These tougheners are included in the formula from 1 to 40 percent of the hardener composition, and more preferably 20-30 percent. Specifically, amine terminated butadiene acrylonitrile copolymers have been found to be particularly useful. Other commonly used toughening modifiers as previously discussed can also be incorporated into the hardener component.

The hardener component can be modified by the addition of diluents from 1 to 20 percent of the hardener composition. Commonly used ingredients are benzyl alcohol and dibutyl pthalate.

The hardener component as defined above is similarly filled with ferromagnetic fillers or other electromagnetic energy absorbing materials such as powdered metals alloys and metal oxides (at 2 to 60 percent of the hardener component) and may also contain other fillers such as talc, silica, kaolin, aluminum oxide, etc. in amounts up to 30 percent by weight. The total amount of both ferromagnetic and nonferromagnetic fillers may range up to 60% of the total weight of this component. The thixotropic properties of the hardener component may be improved by adding 1 to 8 percent by weight of fumed silica. Also, as an alternative to adding the electrically conductive carbon black to the epoxy resin component, the carbon black can be added to the hardener component instead, at the loading previously discussed (0.1 to 25.0 percent by weight). Additionally, as another embodiment, the electrically conductive carbon black can be added to both the epoxy resin and the hardener component at a total loading for the entire adhesive composition of 0.1 to 25.0 percent by weight.

The two components as described above provide a high performance adhesive when mixed. This adhesive formulation allows for the satisfactory bonding within one minute of induction heating with frequencies of 10 kHz and below. Because it is amenable to rapid low frequency induction heating, the adhesive formulation avoids many of the disadvantages of high frequency induction heating in terms of complexities in design and implementation which are previously discussed.

In contrast to the vacuum tube technology of high frequency generators, lower frequency (10 kHz and below) induction generators are based on solid state electronics. These generators require much less capital investment than the high frequency (450 kHz and above) induction generators. The lower frequency generators are inherently more energy efficient and reliable. Flexible water cooled cables can be used as transmission lines. These lines suffer minimal power loss in contrast to the solid copper bar required for the high frequency induction generators. The length of the transmission line is not a design limitation because of the high efficiency and minimal power loss. The low frequency induction generator can be located far away from the induction coil in the work station. The transmission line can be run along the ceiling from an adjoining room leaving the work station unencumbered. The lower frequency induction generators operate at much lower voltages (100-300 volts) than their high frequency counterparts. These lower operating voltages greatly reduce the tendency for arcing to occur. The lower probability to arc combined with an uncongested work station helps to alleviate severe safety hazards. Because of their high efficiency, low frequency induction generators do not require as many expensive magnetic concentrators. Likewise, cooling water demand is greatly reduced with low frequency induction generator operation. Because low frequency induction generators rely on solid state electronics and not vacuum tube technology there is a low probability that the machine will require servicing during a production run. Additionally, low frequency induction generators do not require FCC certification and do not tend to interfere with electronic equipment in the immediate work area.

DESCRIPTION OF PREFERRED EMBODIMENTS

The following nonlimiting examples are intended to illustrate the compositions, methods and products of the invention and the advantages thereof.

EXAMPLE 1

TABLE I

| | |
|---|---|
| Resin Component | |
| DGEBA (1) | 51.5 |
| DGECHM (2) | 4.5 |
| 1,3-Dihydroxybenzene | 4.0 |
| Red Iron Oxide (3) | 30.0 |
| Conductive Carbon Black (4) | 5.0 |
| Calcium Carbonate (5) | 5.0 |
| Total | 100.0 |
| Hardener Component | |
| Butadiene - Acrylonitrile Copolymer (6) | 22.5 |
| Phenalkamine Curing Agent (7) | 20.5 |
| Benzyldimethylamine | 3.0 |
| Benzyl Alcohol | 6.5 |
| Red Iron Oxide (3) | 25.5 |
| Calcium Carbonate (5) | 20.0 |
| Hydrophilic Fumed Silica (8) | 2.0 |
| Total | 100.0 |

(1) Diglycidyl Ether of Bisphenol A having an epoxy equivalent weight of 190.
(2) Diglycidyl Ether of Cyclohexane Methanol.
(3) Magnetic Red Iron Oxide, Pfizer MO-2228.
(4) Conductex SC, Columbian Chemicals.
(5) Gammasperse 6532, Georgia Marble Co.
(6) Amine Terminated Butadiene Acrylonitrile Copolymer having a molecular weight of 3000, an acrylonitrile content of 16% and an amine hydrogen equivalent weight of 900.
(7) Phenalkamine curing agent consisting of aliphatic polyamines attached to an aromatic backbone with an amine hydrogen equivalent weight of 81, Cardolite NC-540
(8) Cabosil M-5, Cabot Corporation.

The resin component was produced by melting the 1,3-dihydroxybenzene into the DGEBA and DGECHM at 80° C. for 30 minutes. The calcium carbonate, red iron oxide and carbon black were added to the cooled liquid resin blend and mixed for one hour in a mixer with planetary blade motion.

The hardener component was produced by warming the butadiene acrylonitrile copolymer and blending it with the phenalkamine curing agent, benzyldimethylamine and benzyl alcohol for 30 minutes at 65° C. The calcium carbonate, red iron oxide and fumed silica were added to the cooled liquid and mixed for one hour in a mixer with planetary blade motion.

The resin and hardener components were mixed at a one to one ratio by mass. Two dry wiped 0.125 inch thick, 4 inch wide by 6 inch long panels of fiber reinforced plastic were bonded with a one inch overlap and a 30 mil bondline gap. The panels were immediately positioned over a 0.5 inch wide copper induction coil connected to a 10 kHz frequency induction generator. The power supplied was 9 kW for a duration of 40 seconds.

At the end of the 40 second cycle, handling strength was checked. Peak surface temperatures of the fiber reinforced plastics appear in Table II. Additional mechanical testing following these measurements appear in Table III.

TABLE II

| Substrate | Panel # | Handling Strength | Peak Surface Temp. °C. |
|---|---|---|---|
| Polyester SMC (1) | 1 | YES | 79 |
| | 2 | YES | 77 |
| | 3 | YES | 79 |
| Polyurea RIM (2) | 1 | YES | 87 |

TABLE II-continued

| Substrate | Panel # | Handling Strength | Peak Surface Temp. °C. |
|---|---|---|---|
| | 2 | YES | 68 |
| | 3 | YES | 71 |

(1) Premix 60401, thermoset polyester Sheet Molding Compound (SMC)
(2) Dow Spectrim HF-85, thermoset polyurea Reaction Injection Molded (RIM)

Each panel was cut into five, one inch wide tensile lap shear specimens and tested per ASTM D3163 at one half inch per minute crosshead speed. For each type of fiber reinforced plastic, tensile lap shear was determined at 25° C., 80° C. and at 25° C. after a one week soak in 55° C. water. The average strengths appear in Table III.

TABLE III

| Substrate | Test Temp. °C. | Tensile Lap Shear Strength, psi | Failure Mode |
|---|---|---|---|
| Polyester SMC | 25 (no soak) | 495 | Delamination |
| | 80 | 310 | Delamination |
| | 25 (soak) | 335 | Delamination |
| Polyurea RIM | 25 (no soak) | 360 | Stock Break |
| | 80 | 230 | Stock Break |
| | 25 (soak) | 290 | Stock Break |

The foregoing examples are intended to illustrate, without limitations, the compositions of the induction curable two-component structural adhesive of the present invention, their preparation, and use thereof in reducing the time for induction curing and allowing the use of low frequency induction generators in the bonding of fiber reinforced engineering thermoset, thermoplastic materials and other plastics. It is understood that changes and variations can be be made therein without departing from the scope of the invention as defined in the following claims.

I claim:

1. A two component adhesive composition which is curable by induction heating which comprises (I) an epoxy resin component comprising (a) an epoxy resin, up to 15% by weight of which is a phenolic cure accelerator, and (II) a hardener component comprising (a) from 5to 80% by weight of a curing agent, (b) up to 15% by weight of a cure accelerator, and wherein the adhesive composition further contains 0.1 to 25% by weight of conductive carbon black and 2 to 60% by weight of an electromagnetic energy absorbing material selected from the group consisting of particulate magnetizable iron, cobalt, nickel alloys of nickel and iron, alloys of nickel and chromium, oxides of iron, oxides of nickel, and mixtures thereof.

2. The composition according to claim 1 wherein the epoxy resin component (I) contains from 2 to 60% by weight of the electromagnetic energy absorbing material.

3. The composition according to claim 1 wherein the hardener component (II) contains from 2 to 60% by weight of the electromagnetic energy absorbing material.

4. The composition according to claim 2 or 3 wherein the epoxy resin component (I) contains from 0.1 to 25% by weight of the conductive carbon black.

5. The composition according to claim 4 wherein (I) further comprises 1 to 40% by weight of a toughener selected from a group consisting of carboxylic acid terminated butadiene-acrylonitrile rubber, acrylonitrile-butadiene-styrene terpolymers, urethane elastomers, dimer and trimer acids, polyamides, polyoxyalkylene amines and mixtures thereof.

6. The composition according to claim 4 wherein (I) further comprises up to 30% by weight of a filler selected from a group consisting of talc, kaolin, silica, aluminum oxide, calcium carbonate and mixtures thereof.

7. The composition according to claim 4 wherein (I) further comprises from 1 to 15% by weight of a di- or tri- glycidyl ether of a polyalkylene glycol or isocyanates.

8. The composition according to claim 4 wherein the phenolic cure accelerator of (I)(a) comprises bisphenol A, resorcinol, salicylic acid and phenol.

9. The composition according to claim 4 wherein (II) further comprises from 1 to 20% by weight of a diluent selected from the group consisting of benzyl alcohol and dibutyl pthalate.

10. The composition according to claim 4 wherein (II) further comprises up to 30% by weight of a filler selected from a group consisting of talc, kaolin, silica, aluminum oxide, calcium carbonate and mixtures thereof.

11. The composition according to claim 4 wherein (II) further comprises 1 to 40% by weight of a toughener selected from a group consisting of carboxylic acid terminated butadiene-acrylonitrile rubber, acrylonitrile-butadiene-styrene terpolymers, urethane elastomers, dimer and trimer acids, polyamides, polyoxyalkylene amines, amine terminated butadiene acrylonitrile copolymer and mixtures thereof.

12. The composition according to claim 4 wherein the curing agent of (II)(a) comprises aromatic ring containing aliphatic polyamine, dimer and trimer acid based polyamides, polymethylene diamines, piperazine ring containing aliphatic amines, cycloaliphatic amines, mannich based cycloaliphatic amines polyether polyamines and polyamines.

13. The composition according to claim 4 wherein the cure accelerator of (II)(b) comprises benzyldimethylamine, boron trifluoride amine complexes, tris-dimethylaminoethylphenol, bisphenol A, resorcinal, salicylic acid and phenol.

14. The composition according to claim 4 wherein the electromagnetic energy absorbing material is iron oxide.

15. The composition according to claim 2 or 3 wherein the hardener component (II) contains from 0.1 to 25% by weight of the conductive carbon black.

16. The composition according to claim 15 wherein (I) further comprises 1 to 40% by weight of a toughener selected from a group consisting of carboxylic acid terminated butadiene-acrylonitrile rubber, acrylonitrile-butadiene-styrene terpolymers, urethane elastomers, dimer and trimer acids, polyamides, polyoxyalkylene amines and mixtures thereof.

17. The composition according to claim 15 wherein (I) further comprises up to 30% by weight of a filler selected from a group consisting of talc, kaolin, silica, aluminum oxide, calcium carbonate and mixtures thereof.

18. The composition according to claim 15 wherein (I) further comprises from 1 to 15% by weight of a di- or tri- glycidyl ether of a polyalkylene glycol.

19. The composition according to claim 15 wherein the phenolic cure accelerator of (I)(a) comprises bisphenol A, resorcinol, salicylic acid and phenol.

20. The composition according to claim 15 wherein (II) further comprises from 1 to 20% by weight of a diluent selected from the group consisting of benzyl alcohol and dibutyl pthalate.

21. The composition according to claim 15 wherein (II) further comprises up to 30% by weight of a filler selected from a group consisting of talc, kaolin, silica, aluminum oxide, calcium carbonate and mixtures thereof.

22. The composition according to claim 15 wherein (II) further comprises 1 to 40% by weight of a toughener selected from a group consisting of carboxylic acid terminated butadiene-acrylonitrile rubber, acrylonitrile-butadiene-styrene terpolymers, urethane elastomers, dimer and trimer acids, polyamides, polyoxyalkylene amines, amine terminated butadiene acrylonitrile copolymer and mixtures thereof.

23. The composition according to claim 15 wherein the curing agent of (II)(a) comprises aromatic ring containing aliphatic polyamine, dimer and trimer acid based polyamides, polymethylene diamines, piperazine ring containing aliphatic amines, cycloaliphatic amines, polyether polyamines and polyamines.

24. The composition according to claim 15 wherein the cure accelerator of (II)(b) comprises benzyldimethylamine, boron trifluoride amine complexes, tris-dimethylaminoethylphenol, bisphenol A, resorcinal, salicylic acid and phenol.

25. The composition according to claim 15 wherein the electromagnetic energy absorbing material is iron oxide.

* * * * *